US005341661A

United States Patent [19]

Dausch et al.

[11] Patent Number: 5,341,661

[45] Date of Patent: Aug. 30, 1994

[54] SENSOR HOLDER HAVING A CONTAINER WITH A PROJECTION FOR COLLECTING FLUID SAMPLES IN A MACHINE FOR CLEANSING ARTICLES

[75] Inventors: Mark E. Dausch, Latham; Walter Whipple, III, Amsterdam; Terry C. Cooper, Schenectady, all of N.Y.; David A. Schneider, Louisville, Ky.

[73] Assignee: General Electric Company, Schenectady, N.Y.

[21] Appl. No.: 166,859

[22] Filed: Dec. 15, 1993

[51] Int. Cl.[5] ..... D06F 39/08

[52] U.S. Cl. ..... 68/207; 68/12.02; 68/12.19; 137/561 A

[58] Field of Search ..... 68/12.02, 12.19, 207; 134/57 D, 113; 137/561 A; 356/440, 442

[56] References Cited

U.S. PATENT DOCUMENTS

| | | | |
|---|---|---|---|
| 3,613,405 | 10/1971 | Shimokuso et al. | 68/12.02 |
| 5,048,139 | 9/1991 | Matsumi et al. | 68/12.02 X |
| 5,136,861 | 8/1992 | Kiuchi et al. | 68/12.02 X |
| 5,259,219 | 11/1993 | Dausch et al. | 68/207 |

*Primary Examiner*—Philip R. Coe

*Attorney, Agent, or Firm*—Enrique J. Mora; Paul R. Webb, II

[57] ABSTRACT

A turbidity sensor holder system having a container with a projection for collecting fluid samples in a machine for cleansing articles is provided. Collector channels are situated in the container projection to collect the fluid to be sampled. One or more vent channels are also provided in the container projection for conveniently venting a reservoir in the container. The present invention with the foregoing collection capability allows the turbidity of the cleansing fluid to be accurately measured without affecting the performance capacity of the sensor.

27 Claims, 1 Drawing Sheet

SENSOR HOLDER HAVING A CONTAINER WITH A PROJECTION FOR COLLECTING FLUID SAMPLES IN A MACHINE FOR CLEANSING ARTICLES

CROSS REFERENCE TO RELATED APPLICATIONS

This application is related to U.S. Pat. No. 5,259,219 entitled "Sensor Holder for a Machine for Cleansing Articles", by Dausch et al., and allowed U.S. patent application Ser. No. 07/877,303, entitled "Machine for Cleansing Articles", by Molnar et al.

BACKGROUND OF THE INVENTION

1. Field of the Invention

This invention relates to a holder system for turbidity sensors of the type used in machines for cleansing articles. Systems of this type, generally, allow the turbidity of the liquid fluid employed in the cleansing of the articles to be accurately measured without affecting the performance capacity of the sensor.

2. Description of the Related Art

Reducing the amount of energy consumed by a machine for cleansing articles, such as a clothes washer or a dishwasher, is a significant problem, in part because of increasing energy costs. In such machines, the amount of energy consumed is primarily determined by the amount of energy needed to heat the water used to wash the articles. Thus, decreased water consumption for such machines may result in a significant and permanent energy efficiency.

Appliances for cleansing articles, such as dishwashers, are typically preprogrammed to perform a complete washing operation in a predetermined number of wash cycles, each wash cycle having a predetermined duration. A wash cycle may comprise the separate operation steps of providing substantially particle-free water into a tub of the cleansing machine (fill cycle), circulating the water during the wash cycle (circulation cycle), and draining or flushing the soiled water from the tub after the water is used to wash the articles (drain cycle). Usually, though, the machine user may only select from the limited number of preprogrammed options. Such preprogramming does not use energy efficiently because the machine often performs a large number of wash cycles, each cycle lasting for an excessive duration, to assure that cleanliness of the articles is achieved. To improve the energy efficiency of such machines, closed loop feedback control has been introduced. Several techniques are available to indirectly monitor cleanliness of the articles during closed loop feedback control of the appliance including use of a device for measuring the turbidity of the liquid used to wash the articles.

Devices for measuring turbidity that detect the transmission of coherent light or other suitable form of electromagnetic radiation propagated through the liquid used to wash the articles have been employed to ascertain information about the progress of the wash. However, these devices are not ideal for use in household appliances. Such devices are often times difficult or non-economical to implement due to the complex electronic circuitry necessary to perform the complex turbidity measurements. Furthermore, such devices are subject to measurement error. Factors such as cleansing liquid turbulence, cloudiness of the liquid sample chamber, light source dimming, or device performance degradation may cause attenuation of the amount of light detected and thus, affect measurement accuracy. The precision of such devices is also not entirely satisfactory. This imprecision has the additional effect of making turbidity measurements provided by such devices difficult to interpret in a closed loop feedback control system.

As disclosed in U.S. Pat. No. 5,259,219, herein incorporated by reference, the location of the sensor is also of importance. For instance, the above referred application discloses how to solve problems generally associated with dishwashers wherein the sensor is located either in the overhead spray arm hose where water is being fed into the machine or in the drain hose where the soiled water or effluent is being drained from the machine. In either of these two instances, the turbulence of the cleansing liquid adversely affects the performance characteristics of the sensor because bubbles that are created by the liquid turbulence may provide a false read in the sensor. This is because the bubbles affect the light measuring characteristics of the sensor.

Although the foregoing allowed patent application discloses a turbidity sensor holder which is capable of efficiently and advantageously measuring the turbidity of the liquid used in cleansing the articles, it is desirable to improve the capability for collecting samples of the cleansing liquid. For instance, the sensor holder system disclosed therein uses liquid collecting holes through a tub wall to collect samples of the cleansing liquid, i.e., water. In this approach the quantity of water collected is dependent on the wettability of the tub wall, that is, the collection of liquid samples in the system depends on how well the water flows along the tub wall as the water droplets run down the tub wall. In general, tub wall materials such as plastics are typically hydrophobic in nature which causes the water droplets to bead. When the water droplets form beads, these beads generally flow bypassing the collecting holes rather than into the holes. A number of approaches, which generally have not been entirely satisfactory due to various detrimental factors, can be used to improve the wettability of the tub wall. For instance, an inner surface of the tub wall can be coated with a hydrophilic material or the inner surface of the tub wall along which the water droplets run down can be chemically treated by a suitable oxidation process to improve its wettability. In each case, the coating or the oxidation treatment imposes manufacturing processes which add to the cost and complexity of the washing machine. Further, either the surface coating or the surface treatment typically wears out with age and usage with the possibility of changing the surface appearance after a relatively short period of time. In addition, it is desirable to provide venting provisions for allowing air to escape from a reservoir of the sensor holder as the reservoir fills with the cleansing liquid to be sampled in a manner that such air is neither obstructed by the cleansing liquid nor by particulates in the cleansing liquid.

It is apparent from the foregoing that there exists a need in the art for a turbidity sensor holder with improved capability for collecting samples of the liquid used in cleansing the articles, and which eliminates the need to provide a coating on the tub wall surface or to chemically alter such tub wall surface. It is a purpose of this invention to fulfill these and other needs in the art in a manner more apparent to the skilled artisan once given the following disclosure.

SUMMARY OF THE INVENTION

The present invention fulfills the foregoing needs by providing a turbidity sensor holder system for a machine for cleansing articles. The system comprises a container which can be attached to an outer surface of a wall of the cleansing machine, such as a tub wall in the cleansing machine, for example. The container has a projection which extends at a predetermined distance away from an inner surface of the wall. The projection includes a respective plurality of collector channels situated to collect fluid, such as water, flowing along the inner surface. The projection further includes at least one or more vent channels situated to vent a reservoir substantially located within the container. A reservoir inlet is located adjacent to a first end of the container. A reservoir outlet is located adjacent to a second end of the container such that the outlet and inlet are in spaced relationship with respect to one another. A turbidity sensor is fluidly coupled to the reservoir outlet at a predetermined distance from the reservoir outlet and a fluid outlet is fluidly coupled to the turbidity sensor and located in the wall of the machine for cleansing articles.

Preferably, the plurality of collector channels slants in a generally downward direction toward the reservoir and the vent channel slants in a generally downward direction away from the reservoir. Further, the collector and vent channels can be formed between predeterminedly spaced partitions cooperating to block particulates from entering into the collector and vent channels. Furthermore, the turbidity sensor is located such that the cleansing fluid and bubbles therein flow upward through the sensor. Thus, the sensor holder system having the container with the projection as described above provides an advantageous and useful improvement for collecting fluid samples in the machine for cleansing articles in a manner which is more efficient and more economical than heretofore, as achieved by prior known sensor holders.

BRIEF DESCRIPTION OF THE DRAWINGS

The above and other features of the present invention which will be more apparent as the description proceeds are best understood by considering the following detailed description in conjunction with the accompanying drawings wherein like characters represent like parts throughout the drawings and in which.

DETAILED DESCRIPTION OF THE INVENTION

Figure 1:
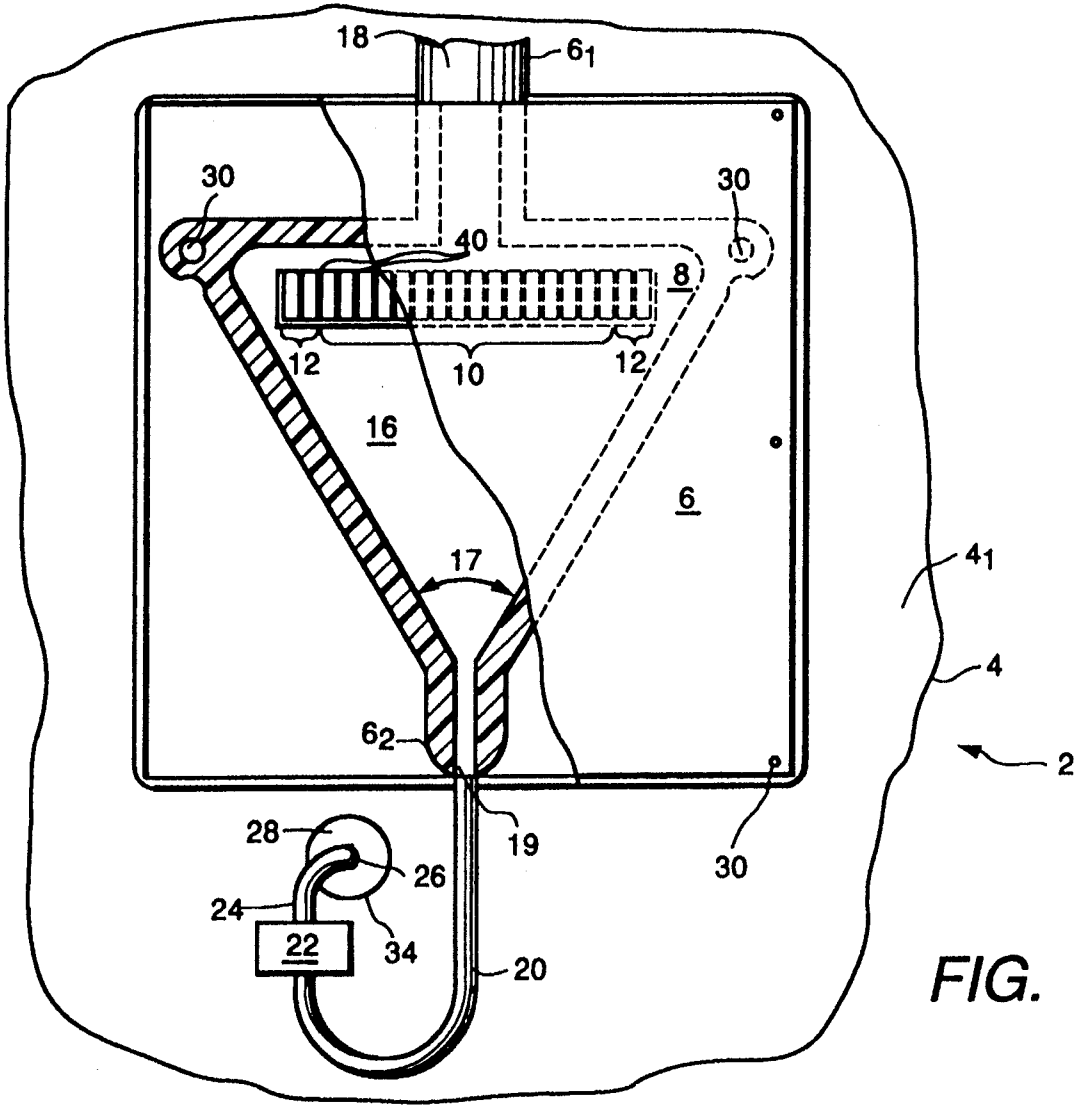
FIG. 1 is a front view of a turbidity sensor holder, according to the present invention.

With reference to FIG. 1, there is illustrated a sensor holder system 2 which can be rigidly attached to the outer surface $4_1$ of a wall 4 of a conventional article cleansing machine (not shown). The wall 4 refers to the wall of a tub (not shown) in the cleansing machine which contains the articles to be cleansed as well as the cleansing liquid used for cleansing such articles. System 2 includes in part reservoir container 6 with projection 8 having a respective plurality of collector channels 10 and at least one or more vent channels 12, reservoir 16, reservoir walls 17, reservoir inlet 18, reservoir outlet 19, a conventional fluid conduit such as the overall tubing made up of conduit segments 20 and 24, turbidity sensor 22, conduit mount 28 having a hole 26, conventional fasteners 30 and hole 34 located in wall 4. The conduit mount and associated hole cooperate to provide a fluid outlet for the cleansing liquid passing through turbidity sensor 22 and in turn circulated back into the tub of the washing machine through hole 34. Reservoir container 6, preferably, is constructed of any suitable polymeric material such as polypropylene. Reservoir inlet 18 and reservoir outlet 19 are in spaced relationship with respect to one another and are respectively located adjacent to first and second ends $6_1$ and $6_2$ of container 6. Preferably, inlet 18 and outlet 19 are machined or molded in reservoir container 6 by conventional machining or molding techniques. Walls 17 are suitably angled with respect to a vertical axis of container 6 so that any debris or particulates that may enter reservoir 16 will traverse down along walls 17 and out through outlet 19. The angle of the walls 17 should be selected such that the debris does not gradually build up and then suddenly avalanches down to outlet 19 and plug up outlet 19. Conduits 20 and 24, preferably, are constructed of any suitable polymeric or elastomeric material. Sensor 22 includes the turbidity measuring device as disclosed in allowed U.S. patent application Ser. No. 07/877,303, by Molnar et al., entitled "Machine for Cleansing Articles" and hereby incorporated by reference. It is to be understood that other types of sensors can be used as sensor 22 such as a conventional conductivity sensor or a conventional Ph sensor. Conduit 20 is rigidly attached at respective ends thereof to outlet 19 and sensor 22 by conventional fasteners (not shown). Conduit 24 is rigidly attached at respective ends thereof to sensor 22 and hole 26 in outlet 28 by conventional fasteners (not shown). Thus, the overall robing made up of conduits 20 and 24 can easily be seen to include four ends which, for example, can be respectively connected as follows: a first end attached to outlet 19, a second end attached to an entrance of sensor 22, a third end to an exit of sensor 22 and a fourth end attached to hole 26.

Figure 2:
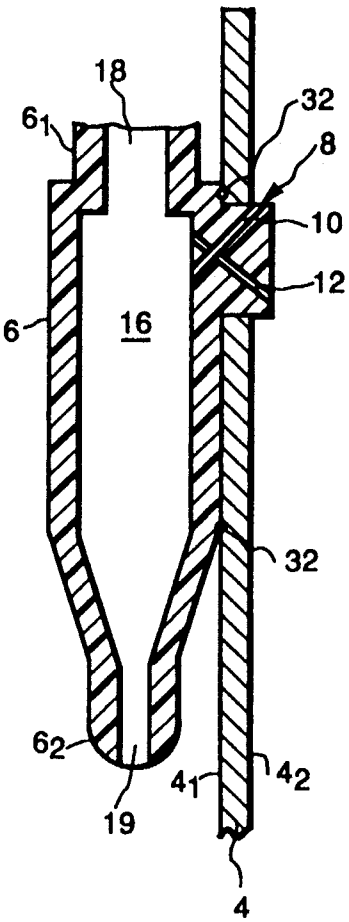
FIG. 2 is a side plan view of the turbidity sensor reservoir container.

With respect to FIG. 2, the projection 8 of container 6 with reference to wall 4 can be more clearly seen. In particular, projection 8 extends at a predetermined distance away from an inner surface $4_2$ of wall 4 such that the respective plurality of collector channels 10 is situated to collect liquid flowing along inner surface $4_2$ of wall 4. In particular it should be appreciated that the plurality of collector channels 10 slants in a generally downward direction toward reservoir 16. This configuration allows liquid flowing along inner surface $4_2$ to fill reservoir 16. Conversely, vent channels 12 can be situated to slant in a generally downward direction away from the reservoir and into the tub of the cleansing machine. This feature advantageously prevents any liquid or particulates from blocking passage of air venting out of reservoir 16 through the vent channels. Container 6 can be rigidly attached to the outer surface of wall 4 by conventional fasteners 30. Alternatively, container 6 as well as other components of holder system 2 can be rigidly attached to outer surface $4_1$ of wall 4 by conventional welding, sealant or adhesive 32. It should be appreciated that the collector and vent channels in projection 8 of container 6 can be integrally constructed in such projection by conventional machining or molding techniques.

With respect to the operation of holder system 2, the machine for cleansing articles, such as a dishwasher, typically, operates over three separate steps of operation or cycles. These cycles being the fill cycle, the circulation cycle and the drain cycle. The fill cycle is usually first and the drain cycle is usually the last cycle. During the operation of system 2, substantially particle-free water is introduced from a water source (not shown) through inlet 18 such that the water enters into reservoir 16 and reservoir 16 begins to fill up. Once reservoir 16 is completely filled up, the pressure of the water in reservoir 16 increases rapidly which causes water to be forced out of the collector and vent channels. The purpose of this initial step is to loosen any debris, such as food matter, that may have been lodged either in the collector or vent channels during the last cycle of operation. At this time, water also begins to run through conduit 20, pass turbidity sensor 22 and out through conduit 24 into hole 26 of outlet 28. The rapid increase in water pressure in reservoir 16, also causes the water to rapidly move through conduit 20 which advantageously, flushes out any debris in sensor 22. During this part of the fill up of the machine, sensor 22 is able to self-clean and self-calibrate with the aid of a conventional controller (not shown) in order to more accurately determine the turbidity of this relatively particle-free water. Also, the increased water pressure during the fill up cycle should cause any debris or particulates located in reservoir 16 to be forced down to outlet 19 and out of reservoir 16.

Once the article cleansing machine has ended its fill up cycle, the circulation cycle begins. During this part of the cycle water that flows along inner surface of wall $4_2$ enters into collector channels 10 and flows down into reservoir 16. This water from reservoir 16 then passes along through sensor 22 and out through hole 26 of outlet 28. During this circulation cycle, the sensor should measure the turbidity of the water.

Finally, during the pump out cycle, water can be drained from holder system 2. Once the pump out cycle is completed, the fill up cycle may begin again if the predetermined level of turbidity in the water has not yet been achieved. Typically, the three operation cycles are performed several times until the predetermined turbidity level is achieved.

It is noted that the location of the sensor with respect to the curvature of conduit 20 is important. Briefly, the operation of the article cleansing machine may create a large amount of turbulence in the cleansing fluid or water. This turbulence typically results in bubbles of various sizes being formed in the cleansing fluid or water. In general, the presence of bubbles in the region where the sensor 22 is performing the turbidity measurement is not desirable being that the accuracy of the turbidity measurement may be affected. Consequently, water from conduit 20 should flow generally upward through sensor 22, in order to keep the bubbles moving through sensor 22. If the bubbles were allowed to stop and remain within sensor 22, this could affect the turbidity measurement of sensor 22.

It is also to be understood that the configuration of reservoir 16 preferably includes slanted walls 17. Besides preventing that debris does not build up and avalanches down to outlet 19 and plug up outlet 19, walls 17 are slanted in order to keep the larger size bubbles of the fluid from entering outlet 19. In this manner, only the smaller sized bubbles will enter into sensor 22. As discussed earlier, the upward flow of the fluid through sensor 22 substantially removes any adverse effect that the smaller bubbles may have on the turbidity measurement of sensor 22.

Finally, the collector and vent channels 10 and 12, respectively, are suitably dimensioned and configured to prevent the introduction of relatively large debris or particulates into reservoir 6 as well as to facilitate the removal of any residual debris. By way of example and not of limitation, both the collector and the vent channels can be suitably partitioned to collectively form a comb-like filtering structure, that is, such channels may be formed between predeterminedly spaced partitions 40 better appreciated in FIG. 1. The foregoing partitions advantageously cooperate to advantageously provide the foregoing filtering effect. In particular, as the article cleansing machine is performing the fill up cycle, water expelled through the collector and vent channels conveniently pushes any debris on partitions 40 back into the article cleansing machine where the debris is typically taken up by the sump pump (not shown). During the circulation cycle, water flows into the collector channels and debris which is too large for outlet 19 should, due to the chosen construction for the collector and vent channels, either become lodged between some of the channel partitions or fall back into the inside of the article cleansing machine where the debris is usually taken up by the sump pump. When the subsequent fill up cycle is performed, the lodged debris is then conveniently pushed back into the machine and is taken up by the sump pump.

Once given the above disclosure, many other features, modification or improvements will become apparent to the skilled artisan. Such features, modifications or improvements are, therefore, considered to be a part of this invention, the scope of which is to be determined by the following claims.

What is claimed:

1. A turbidity sensor holder system for a machine for cleansing articles, said holder system comprising:

a container attached to an outer surface of a wall of said machine for cleansing articles, said container having a projection extending at a predetermined distance away from an inner surface of said wall, said projection including a respective plurality of collector channels situated to collect fluid flowing along said inner surface and at least one vent channel;

a reservoir substantially located within said container, said vent channel in said projection situated to vent air out of said reservoir;

a reservoir inlet located adjacent to a first end of said container;

a reservoir outlet located adjacent to a second end of said container, said reservoir inlet and outlet being in spaced relationship with respect to one another;

a turbidity sensor fluidly coupled to said reservoir outlet at a predetermined distance from said reservoir outlet; and a fluid outlet fluidly coupled to said turbidity sensor and located in said wall of said machine for cleansing articles.

2. A holder system in accordance with claim 1 wherein said plurality of collector channels slants in a generally downward direction toward said reservoir.

3. A holder system in accordance with claim 1 wherein said vent channel slants in a generally downward direction away from said reservoir.

4. A holder system in accordance with claim 1 wherein said collector and vent channels are formed between predeterminedly spaced partitions cooperating to block particulates from entering into said collector and vent channels.

5. A holder system in accordance with claim 1 wherein said container is rigidly attached to said outer surface of said wall.

6. A holder system in accordance with claim 1 wherein said reservoir is further comprised of an angled wall located between said reservoir inlet and said reservoir outlet.

7. A holder system in accordance with claim 1 further comprising a respective fluid conduit for coupling said reservoir outlet, said turbidity sensor and said fluid outlet.

8. A holder system in accordance with claim 7 wherein said vent channel slants in a generally downward direction away from said reservoir.

9. A holder system in accordance with claim 8 wherein said plurality of collector channels slants in a generally downward direction toward said reservoir.

10. A holder system in accordance with claim 9 wherein said reservoir is further comprised of an angled wall located between said reservoir inlet and said reservoir outlet.

11. A holder system in accordance with claim 10 wherein said collector and vent channels are formed between predeterminedly spaced partitions cooperating to block particulates from entering into said collector and vent channels.

12. A holder system in accordance with claim 10 wherein said fluid conduit is further comprised of:

first, second, third and fourth ends.

13. A holder system in accordance with claim 12 wherein said turbidity sensor is substantially located between said second and said third ends of said fluid conduit such that said third end is located substantially above said second end.

14. A holder system in accordance with claim 13 wherein said container is rigidly attached to said outer surface of said wall.

15. A turbidity sensor holder system for a machine for cleansing articles, said holder system comprising:

a container attached to an outer surface of a wall of said machine for cleansing articles, said container including a projection extending at a predetermined distance away from an inner surface of said wall, said projection including a respective plurality of collector channels situated to collect fluid flowing along said inner surface and at least one vent channel;

a reservoir substantially located within said container, said vent channel in said projection situated to vent said reservoir;

a reservoir inlet located adjacent to a first end of said container;

a reservoir outlet located adjacent to a second end of said container, said reservoir inlet and outlet being in spaced relationship with respect to one another;

a turbidity sensor fluidly coupled to said reservoir outlet at a predetermined distance from said reservoir outlet;

a fluid outlet fluidly coupled to said turbidity sensor and located in said wall of said machine for cleansing articles; and a fluid conduit for coupling said reservoir outlet, said turbidity sensor and said fluid outlet.

16. A holder system in accordance with claim 15 wherein said plurality of collector channels slants in a generally downward direction toward said reservoir.

17. A holder system in accordance with claim 16 wherein said vent channel slants in a generally downward direction away from said reservoir.

18. A holder system in accordance with claim 17 wherein said collector and vent channels are formed between predeterminedly spaced partitions cooperating to block particulates from entering into said collector and vent channels.

19. A holder system in accordance with claim 17 wherein said container is rigidly attached to said outer surface of said wall.

20. A holder system in accordance with claim 19 wherein said reservoir is further comprised of an angled wall located between said reservoir inlet and said reservoir outlet.

21. A holder system in accordance with claim 20 wherein said fluid conduit is further comprised of:

first, second, third and fourth ends.

22. A holder system in accordance with claim 21 wherein turbidity sensor is substantially located between said second and said third ends of said fluid conduit such that said third end is located substantially above said second end.

23. A container for collecting fluid samples in a turbidity sensor holder system for a machine for cleansing articles wherein said container is attached to an outer surface of a wall of said machine for cleansing articles, said container comprising:

a projection extending at a predetermined distance away from an inner surface of said wall, said projection including a respective plurality of collector channels situated to collect fluid flowing along said inner surface and at least one vent channel;

a reservoir substantially located within said container, said vent channel in said projection situated to vent said reservoir;

a reservoir inlet located adjacent to a first end of said container; and a reservoir outlet located adjacent to a second end of said container, said reservoir inlet and outlet being in spaced relationship with respect to one another.

24. A container in accordance with claim 23 wherein said plurality of collector channels slants in a generally downward direction toward said reservoir.

25. A container in accordance with claim 24 wherein said vent channel slants in a generally downward direction away from said reservoir.

26. A container in accordance with claim 23 wherein said collector and vent channels are formed between predeterminedly spaced partitions cooperating to block particulates from entering into said collector and vent channels.

27. A container in accordance with claim 26 wherein said reservoir is further comprised of an angled wall located between said reservoir inlet and said reservoir outlet.

* * * * *